US006057750A

United States Patent [19]

Sheng

[11] Patent Number: 6,057,750

[45] Date of Patent: May 2, 2000

[54] MAGNET DEVICE WITH DOUBLE FIXING POSITIONS FOR CHANGING THE MAGNETIC CIRCUIT

[76] Inventor: Chih-Sheng Sheng, No. 100 Tzu Chiang W. Road, Kweishan Hsiang, Tao-Yuan Hsien, Taiwan

[21] Appl. No.: 09/305,470

[22] Filed: May 6, 1999

[51] Int. Cl.[7] ..... H01F 7/122; H01H 47/00

[52] U.S. Cl. ..... 335/234; 335/229; 335/230; 361/139; 361/156; 361/208

[58] Field of Search ..... 335/177–183, 335/229–234, 239, 253, 255; 361/139, 155, 156, 160, 206, 208; 310/15, 17

[56] References Cited

U.S. PATENT DOCUMENTS 5,394,131 2/1995 Lungu ..... 335/229

*Primary Examiner*—Michael L. Gellner
*Assistant Examiner*—Raymond Barrera
*Attorney, Agent, or Firm*—Rosenberg, Klein & Lee

[57] ABSTRACT

A magnet device with double fixing positions for changing the magnetic circuit is provided, and includes an external housing whose inner edge is fitted with a coil The inside of the external housing includes a space for the axial movement of an iron core. The external housing and a positioning cover at the opening end of the housing are made of metal with excellent magnetic conductivity. The iron core is connected to a permanent magnet which is fixed at the inner side of the positioning cover. A drive circuit is provided whereby a positive impulse voltage will be output and the electrical energy is saved in a capacitor when the power is switched on. A discharge current is created to output a negative impulse voltage after the power is switched off, and the positive and the negative impulse voltages serve to make the coil change the direction of the magnetic force by the excitation process, so that a push force or a pull force on the iron core will be created for movement thereof. The permanent magnet will be forced to change the magnetic circuit and the iron core under ordinary circumstances will be kept at the pre-arranged position without continuous waste of electricity. Not only can this save electric energy, but it will avoid creating an over-heated state or a short circuit, so that a dangerous situation is prevented and the useful life of the device is extended.

5 Claims, 13 Drawing Sheets

MAGNET DEVICE WITH DOUBLE FIXING POSITIONS FOR CHANGING THE MAGNETIC CIRCUIT

BACKGROUND OF THE INVENTION

1. Field of the Invention

The present invention relates to a magnet device with double fixing positions for changing the magnetic circuit, and more particularly to a magnet device which can be applied to electromagnetic valve, solenoids, relays and etc. and whose both sides make use of the magnetic force to produce the holding force without using spring to produce a reverse holding force. Accordingly, the position of the iron core can be changed without continuous supply with electricity so that a an over-heated state through a long time use can be prevented to burn down it and the electricity is therefore able to be saved.

2. Description of the Prior Art

The notions of magnetic force was got from the natural magnetic stone which attracts iron slag without magnetization, and the position attracting slag most is called magnetic pole. In respect of the earliest scientific research on the magnetic phenomena, it was performed by a Dane, Hans Christian Oersted, in 1819 who first found the magnetic needle will be deviated when it comes near to the connection wire supplied with electricity.

It was known by research afterwards that the magnetic field hat lines of force. FIG. 14 shows that the lines of force extends from the N pole of a magnet through air to an S pole while FIG. 15 shows that the field is formed because the wire is wound to be solenoids and is supplied with electricity (i), and that the lines of force extends from one end of the solenoid through air to another end, whereby a closed circuit is formed inside of the solenoid. Therefore, lines of force extends from the N pole to the S pole and shows a closed state. Besides, Ampere, a French physicist, found in the beginning of 19 century that the reason of the field created by a magnet is the same to that of the field created by solenoids—that is, he thought that the field effect created by the magnet is resulted from the electric current therein or on the surface.

Nowadays, the magnetic field effect has been broadly applied to the electromagnetic valves, solenoids and relays. FIG. 16 shows a schematic drawing of a conventional electromagnetic valve which makes use of the magnetic force created by a coil 1C, when excited, to attract a iron core 1F to achieve the aim of opening valve 1V. However, the iron core 1F of this kind of electromagnetic valves must be fitted with a spring 1S to provide with a reverse holding force. In order to keep the electromagnetic valves in a opened state, the coil 1C must be continuously excited. As shown in FIG. 17, the magnetic force of the coil is made use to attract the iron core 1F to the right, so that the plastic pad 1P is separate from the valve hole. However, the outward resilient force of the spring 1S will counteract the magnetic force of the coil 1C. Accordingly, increasing power energy is apparently wasted; moreover, that being existed for a long time to attract the iron core 1F can not only waste the power energy, but also make the electromagnetic valves heated, so that a short circuit or burn down is easily caused to bring danger. In addition, the using life is also reduced. This has been disclosed in Taiwan Patent No. 319343, 290615, 115728, 268552, 304570, 155433, 222448, 182896, 212501 and 241854.

The above-mentioned patents have its own advantages and disadvantages. And the common disadvantage lies in that a spring is made use for supplying reverse holding force.

SUMMARY OF THE INVENTION

It is the main object of the present invention to provide a magnet device with double fixing positions for changing the magnetic circuit in which the double positioning under ordinary circumstances makes use of a permanent magnet to produce the holding force without the disadvantage of using a spring which is applied to the conventional holding type magnet device.

It is another object of the present invention to provide a magnet device with double fixing positions for changing the magnetic circuit in which only an instant (0.01 sec) of impulse voltage is needed for changing the position of the iron core by being excited, without supply of electricity for a long time so that it can be prevented from danger of being heated, over-warmed or burnt down and the using life can be extended.

It is a further object of the present invention to provide a magnet device with double fixing positions for changing the magnetic circuit in which a positive impulse voltage will be exported and the electrical energy is saved into the capacitor when the power is switched on, while a discharge current is created to export a negative impulse voltage after the power is switched off, whereby the positive and the negative impulse voltage at this moment serves to make the coil to change the direction of the magnetic force by the excited process so that a push force or a pull force to the iron core will be created for movement thereof, and whereby the permanent magnet will be forced to change the magnetic circuit and the iron core under ordinary circumstances will be kept at the pre-arranged position for saving the electrical energy.

It is still another object of the present invention to provide a magnet device with double fixing positions for changing the magnetic circuit which has a simple configuration, low production cost, is easy to be applied to electromagnetic valves, solenoids, relays and etc.

BRIEF DESCRIPTION OF THE DRAWINGS

The drawings disclose illustrative embodiments of the present invention which serves to exemplify the various advantages and objects hereof, and are as follows.

DETAILED DESCRIPTION OF THE PREFERRED EMBODIMENT

Figure 1:
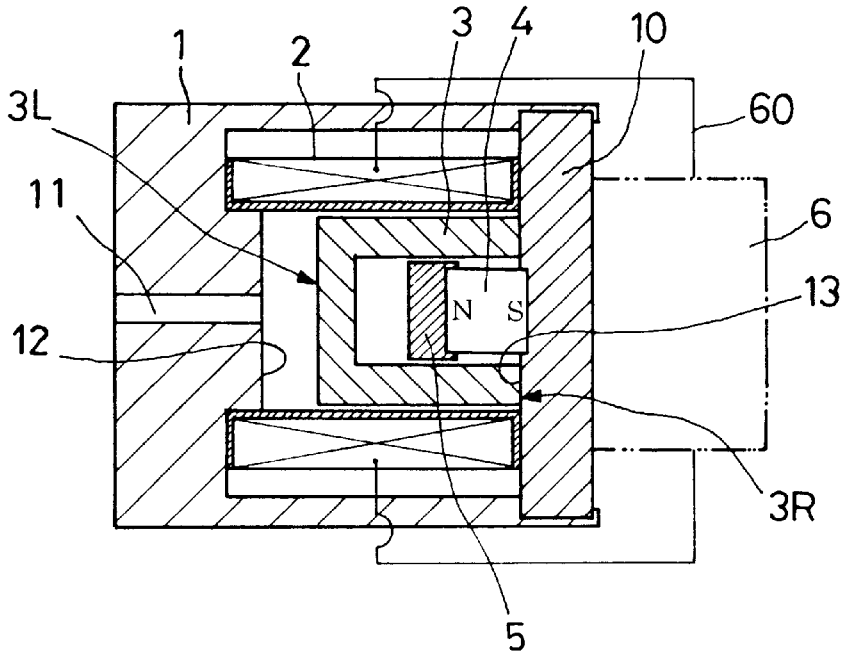
FIG. 1 is a cutaway view of an applicable embodiment of the present invention, illustrating the position of the iron core shifted to the right.
Figure 2:
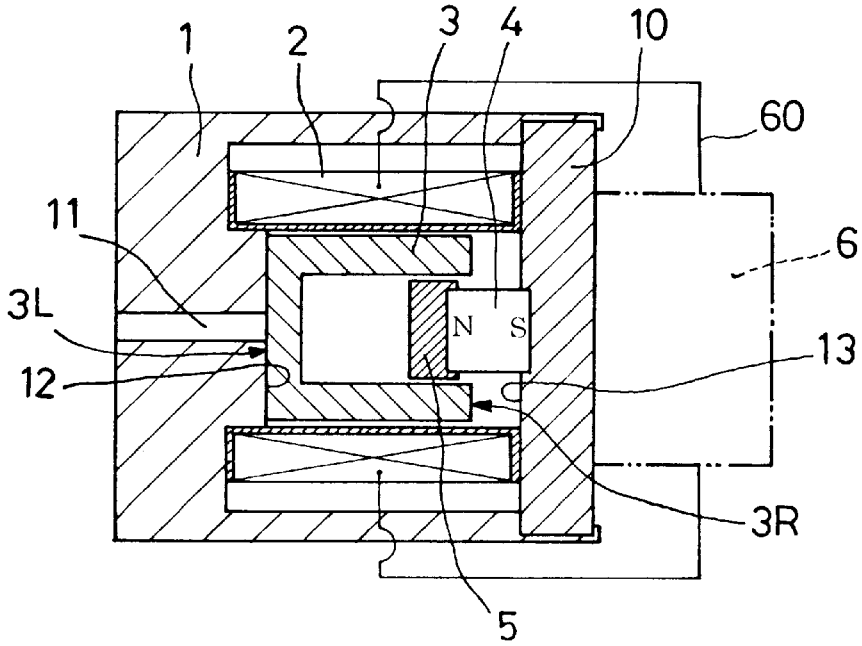
FIG. 2 is a cutaway view of the applicable embodiment of the present invention, illustrating the position of the iron core shifted to the left.

First of all, referring to FIGS. 1 and 2, the embodiment of the present invention includes:

an external housing 1 which can be cylindrical, square-shaped, with single arm type or with another shapes and whose inner edge is fitted with coil 2, whereby the inside of the external housing 1 includes a space for the axial movement of a iron core 3 at different positions, and the partial main body of the iron core 3 under ordinary circumstances has to be coupled with the inner edge of the coil 2; characterized in that the external housing 1 and the positioning cover 10 at the opening end thereof are made of metal with excellent magnetic conductivity, and that the outer part thereof is fitted with a radial bore hole 11, whereby the edge of the inner side thereof is in conjunction with the outer face 3L of the iron core 3 to form an attracting holding face 12 for attracting and attaching with each other; and that the iron core 3 is connected to a permanent magnet 4 which is fixed at the inner side of the positioning cover 10 and one (S pole) of whose magnetic poles together with the positioning cover 10 must contact the conductive magnet, and that the inner face of the positioning cover 10 at the edge of the permanent magnet 4 is in conjunction with the inner face 3R of the iron core 3 to form a attracting holding face 13 for attracting and attaching with each other; and a drive circuit 6 which can be independently installed or installed at one side face of the external housing 1 whose power output wire 60 is connected with the above-mentioned coil 2, so that a positive impulse voltage will be exported and the electrical energy is saved into the capacitor when the power is switched on, while a discharge current is created to export a negative impulse voltage after the power is switched off, whereby the positive and the negative impulse voltage (ca. 0.01 sec.) at this moment serves to make the above-mentioned coil 2 to change the direction of the magnetic force by the excited process so that a push force or a pull force to the iron core 3 will be created for movement thereof, and whereby the permanent magnet 4 will be forced to change the magnetic circuit and the above-mentioned iron core 3 under ordinary circumstances will be kept at the pre-arranged position.

Furthermore, the iron core 3, as shown in FIGS. 1 and 2, is a hollow cylinder made of the magnetic metal and fitted with a opening at one end thereof, while the permanent magnet 4 is cylindrical and mounted at the hollow position of the iron core 3, so that the permanent magnet 4 is externally coupled with the iron core 3. Besides, the above-mentioned permanent magnet 4 at another magnetic pole (N pole) opposite to the magnetic pole (S pole) at fixed end is disposed with a magnet-conductive end piece 5 so as to enhance the magnetic effect.

Figure 3:
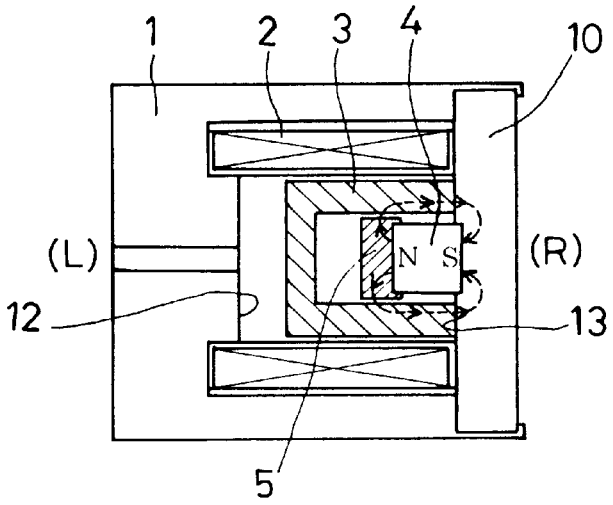
FIG. 3(A) shows lines of force before being excited in accordance with FIG. 1.
FIG. 3(B) shows lines of force in accordance with FIG. 1 when being excited opened by positive impulse voltage.
FIG. 3(C) shows lines of force after the iron core is shifted to the left.
FIG. 3(D) shows lines of force in accordance with FIG. 2 when being excited opened by negative impulse voltage.
FIG. 3(E) shows a schematic drawing after being excited in accordance with FIG. 2.
FIG. 3(F) shows lines of force after the iron core is shifted to the right.
Figure 3:
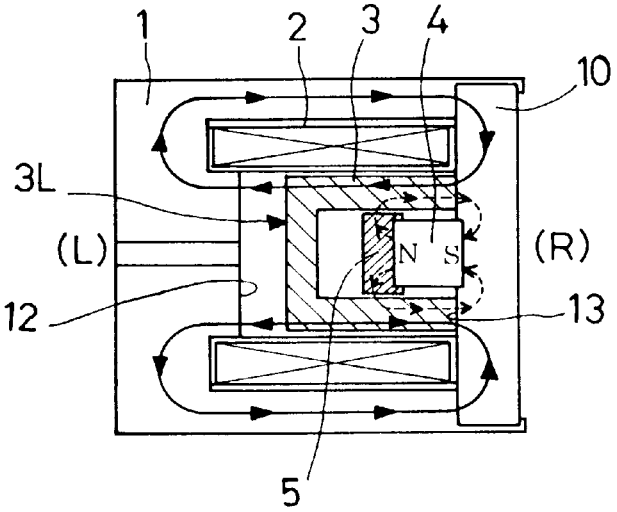
Figure 3:
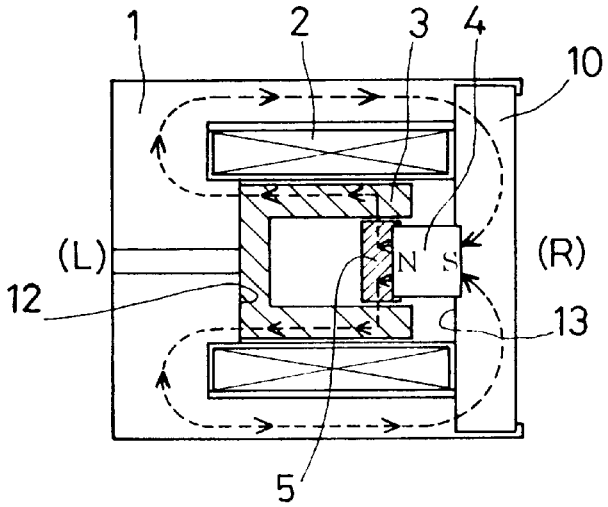
Figure 3:
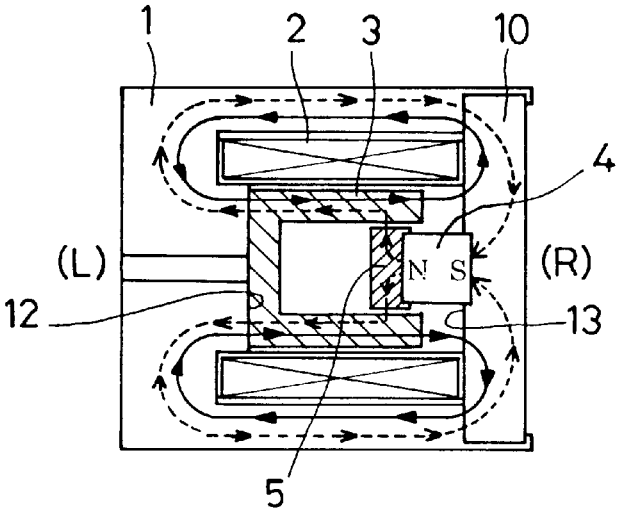
Figure 3:
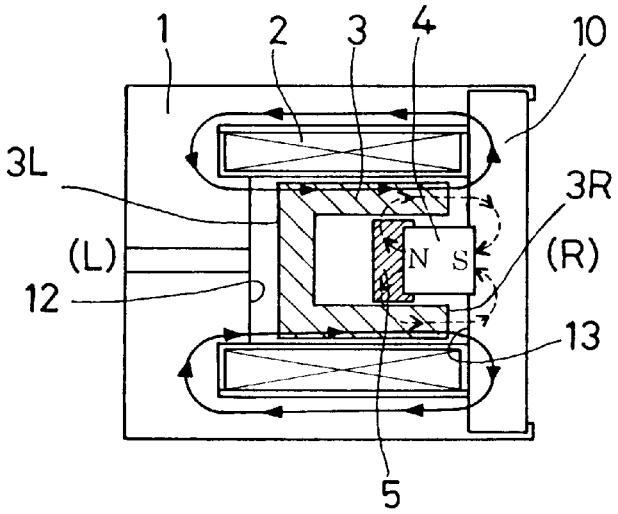
Figure 3:
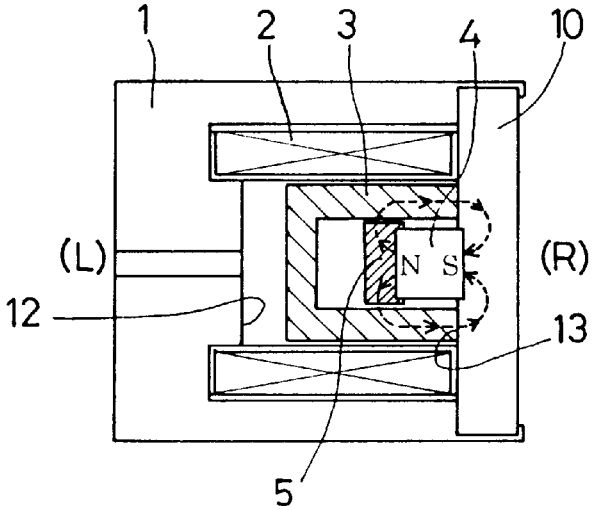

Please refer to FIG. 3. FIG. 3(A) illustrates a schematic drawing of the non-excited magnetic force lines in accordance with FIG. 1—that is, when the power is shut down and the coil 2 is not excited, the magnetic force lines of the permanent magnet 4 will start from the N pole, pass through the magnet-conductive end piece 5, the iron core 3, the attracting holding face 13 of the positioning cover 10 and return to the S pole to form a closed magnetic circuit. The dotted lines shows route properties of magnetic force lines for the permanent magnet 4 so that the permanent magnet 4 attracts the iron core 3 to the right (R) and provides with a holding force in order for the iron core 3 to be kept attracted and attached here.

FIG. 3(B) illustrates a schematic drawing of the excited magnetic force lines by providing with a (positive) impulse voltage in accordance with FIG. 1—that is, when the coil 2 is supplied with a certain voltage to produce a magnetic force greater than that of the permanent magnet 4 (as shown with full arrows) so as to cancel the original magnetic force route (as shown with dotted arrows) of the permanent magnet 4 and to cause a repulsion effect on the attracting holding face 13. Accordingly, the direction of the magnetic force of the permanent magnet 4 is changed with that of the coil 2. Thereafter, the iron core 3 will be forced by the magnetic forces of the coil 2 and the permanent magnet 4 to be pushed out to the left (L), whose position is shown in FIG. 3 (C). The iron core 3 is able to be kept at this position by means of the closed magnetic circuit from N pole→through the magnet-conductive end piece 5→the iron core 3→the attracting holding face 12→the external housing 1→the positioning cover 10→back to S pole. At this moment, the coil 2 doesn't required to be excited and it's ready to attract and hold the iron core 3 to the left (L).

FIG. 3(D) illustrates a schematic drawing of the excited magnetic force lines by providing with a (negative) impulse voltage in accordance with FIG. 2. The iron core 3 is situated at the left side. In order to shift the iron core 3 to the right, the route of the magnetic force lines thereof must be contrary to the direction of the magnetic force lines of the permanent magnet 4. Therefore, if the coil 2 in FIG. 3(B) is supplied with the positive impulse voltage, the impulse voltage in FIG. 3(D) is negative so as to make the magnetic lines route to create a pull effect (as shown with full arrows) on the iron core 3 and to be contrary to the route (as shown with dotted arrows) of the magnetic force of the permanent magnet 4. Accordingly, the original magnetic force (as shown with dotted arrows) of the permanent magnet 4 will be counteracted and a repulsion effect on the attracting holding face 12 is created. Thereafter, it will be shifted to the right at the position shown in FIG. 3(E). At this moment, it's not necessary to supply the coil 2 with power. The iron core 3 is able to be attracted to the right by means of the attracting holding face 13 of the permanent magnet 4. The reason therefor is that the magnetic force lines take the nearest route. Meanwhile, the iron core 3 is able to be kept to the right (R) at the position shown in FIG. 3(F) by means of the magnetic circuit from N pole→through the magnet-conductive ring 5→the iron core 3→the attracting holding face 12 of the positioning cover 10→back to S pole.

From the above-mentioned embodiment, the present invention is mostly characterized in that the position of the iron core 3 is changed by the magnetic force created by the coil 2, while the magnetic force lines will take the nearest route. Meanwhile, the magnetic circuit of the permanent magnet 4 will also be changed. If the magnetic force of the reverse coil won't be added, the iron core 3 will lose the magnetic force of the permanent magnet 4 to be kept at that position. Thus, if the magnet device is made of a permanent magnet with the same magnetic force, the present invention obtains the greatest holding force. It's not required for the present invention to use spring for providing with a reverse holding force (the amount of the reverse holding force is so much as the holding force created by the positive magnetic force) as done by the conventional holding type magnet device. The both sides of the present invention make use of the magnetic force of the permanent magnet to produce the holding force since the present invention can change the magnetic circuit.

Furthermore, when the present invention changes position, the position of the iron core 3 can be changed only by adding the impulse voltage (0.01 sec.) without supplying electric current. Not only can this save the electric energy, won't result in an over-heated state or the short circuit to be burnt down, but also prevent from danger and extend the useful life.

As for the excited opened drive circuit 6, it is shown in FIGS. 1 and 2. It can be installed at a certain position of the side face of the external housing 1 or independently installed according to the wishes. Thereafter, the power output wire 60 and the coil 2 are secured together. Please refer to FIGS. 7 and 8 in which a schematic drawing and a detailed circuit diagram of the drive circuit of AC power applied to the present invention are illustrated respectively. When the plug 61 is connected to the AC power, the AC power will be commutated by the charging circuit to be the high voltage DC power which is thereafter changed over to the low voltage DC power with the switching method which passes through the coil 2 to the capacitor C11 for charging. Then, the coil 2 will be excited by the charging current and the position of the iron core 3 will be changed. Besides, when the AC power continue to supply, no charging current is existing because the capacitor C11 is full-charged. Thereafter, the charging circuit only completes the electric current leaked in the capacitor C11 (the leaked electric current in the capacitor C11 is very slight) in order to keep the capacitor C11 with a stable voltage. When the AC power is shut down, the discharge circuit obtains signals and is operated to be connected to switch (SW) and the discharge circuit of the capacitor C11 supplies the coil 2 with a negative impulse voltage, as shown in FIG. 3(D). Accordingly, the iron core 3 will be pulled back by the magnetic force of the coil 2 and returns to the position at the right (R) side, as shown in FIG. 3(F).

Figure 7:
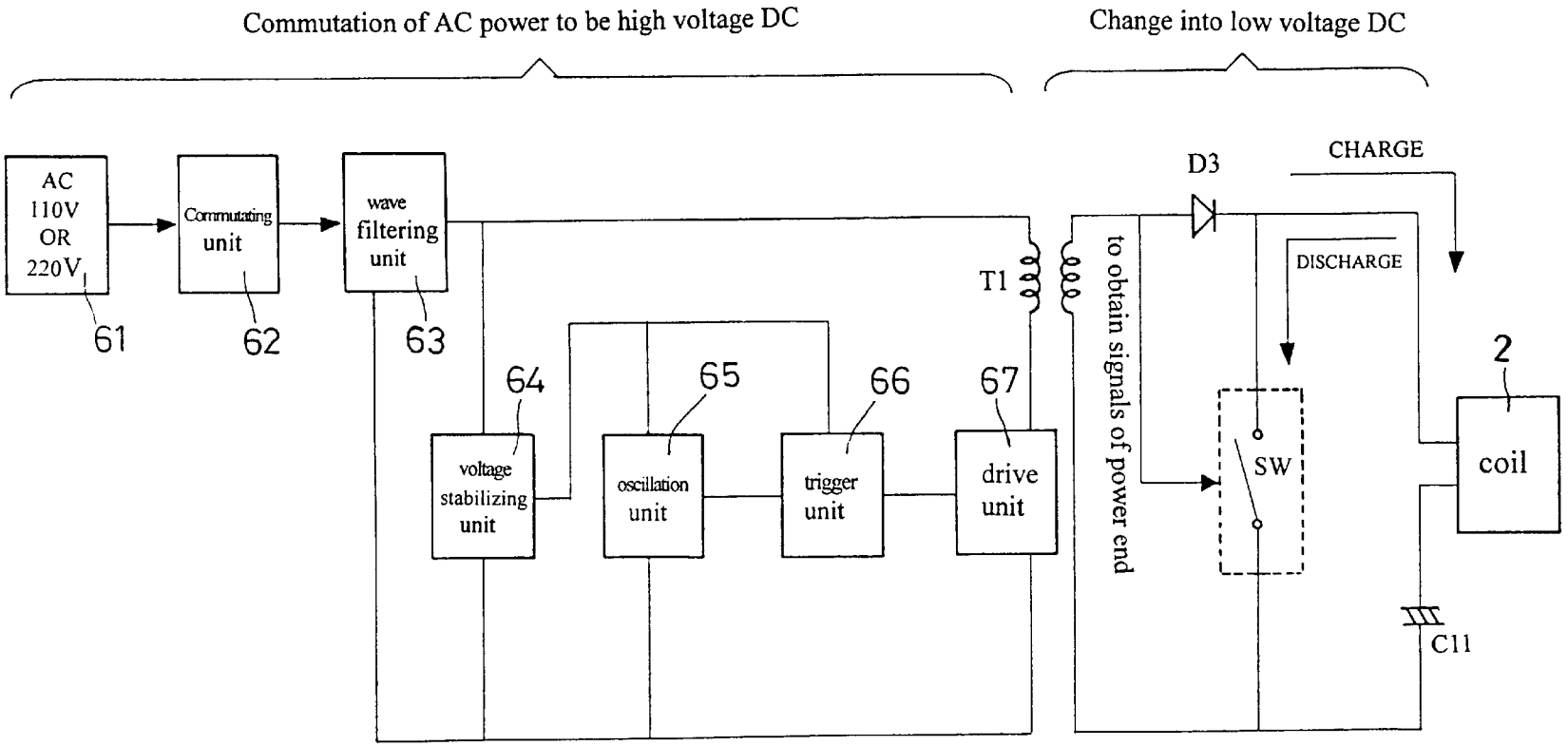
FIG. 7 is a block diagram for drive circuit of the present invention by using AC power.
Figure 8:
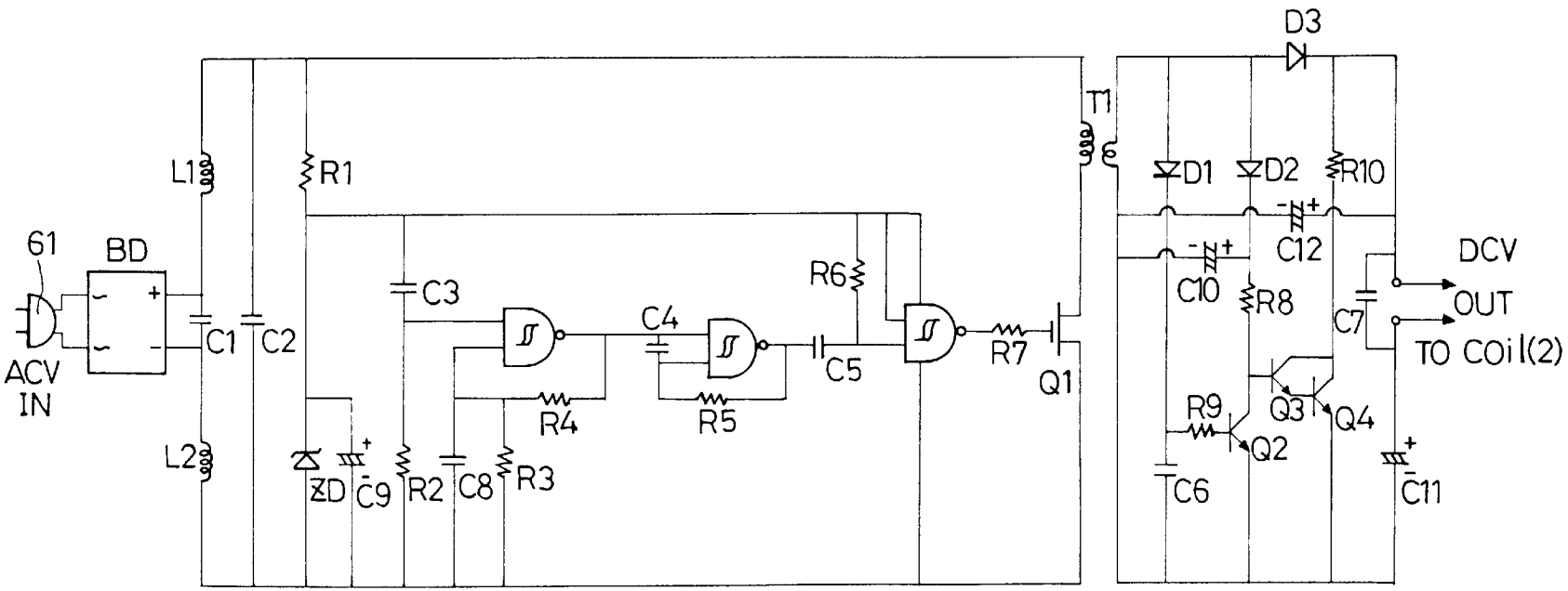
FIG. 8 is a detailed circuit diagram for the drive circuit of the present invention by using AC power.

Please refer to FIGS. 7 and 8 in which a schematic drawing and a detailed circuit diagram of the drive circuit 6 of AC power applied to the present invention are illustrated respectively. The function of each electronic part is described as follows:

The bridge type commutator BD is used as commutating unit 62, the electric sensors L1 and L2 and capacitor C1 and C2 as wave filtering unit 63, the Z-diode ZD and the capacitor C9 as voltage stabilizing unit 64. When the power is just switched on, the capacitor C3 and the resistance R2 will be fully exported in the first 0.01–0.05 sec. so as to supply the positive impulse voltage. Thereafter, only one thousandth of power output will be supplied to complete the leaked electric current in the capacitor. An oscillation unit 65 and a trigger unit 66 is formed by NAND gate while MOS FET drive transistor Q1 serves as a drive unit 67. Besides, a transformer T1 is fitted for transforming the DC high voltage through the diode D3 to be DC low voltage while the DC low voltage provided by the charging circuit will pass through the coil 2 and charge the capacitor C11. When the DC power is switched off, the discharge circuit gains signals to switch on the switch SW formed by Q3 and Q4, so that the discharge current of the capacitor C11 provides the coil 2 with a negative impulse voltage. The capacitor C6 and the transistor Q2 serves as a charge circuit, and Q3 and Q4 of the switch SW should not be supplied with electric current when the charging circuit is operated. Moreover, D2, C10 and R8 make the voltage to discharge completely, and R10 serves for discharge and current limit while C12 and C7 serve for filtering waves.

Figure 9:
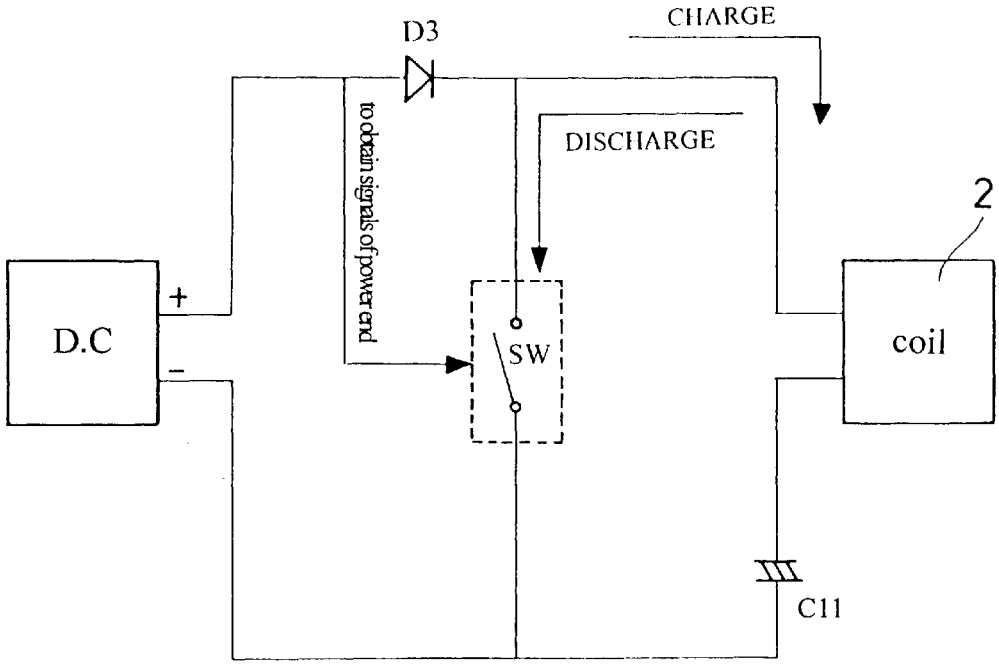
FIG. 9 is a block diagram for drive circuit of the present invention by using DC power.
Figure 10:
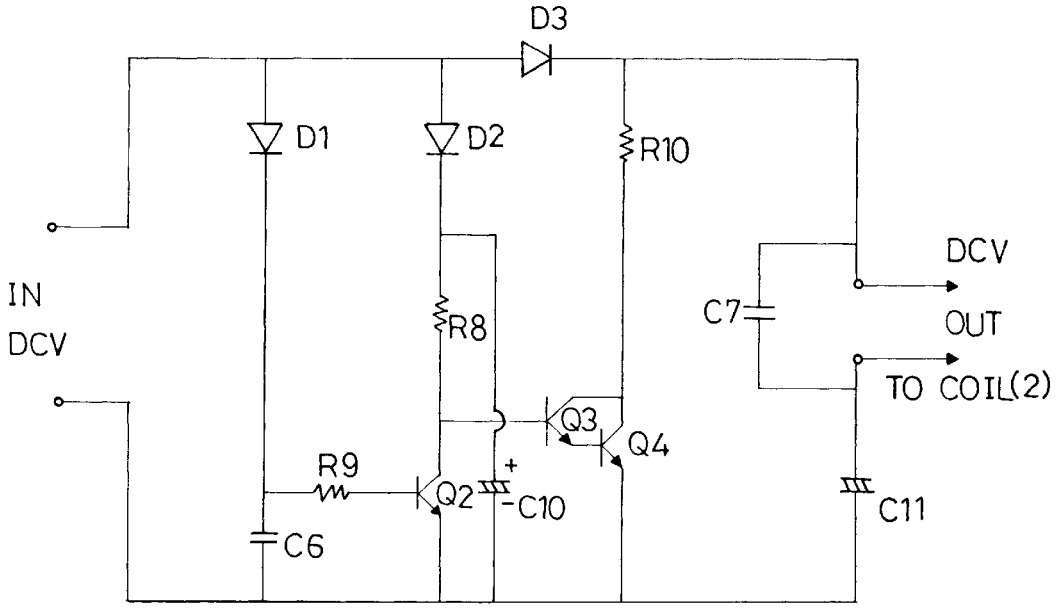
FIG. 10 is a detailed circuit diagram for the drive circuit of the present invention by using DC power.

FIGS. 8 and 9 is a drive circuit supplying with a DC power. The charging and discharging principles and structure thereof are the same to that of the abovementioned AC power, and without transforming voltage so that it is more simple and won't be described herein.

Figure 4:
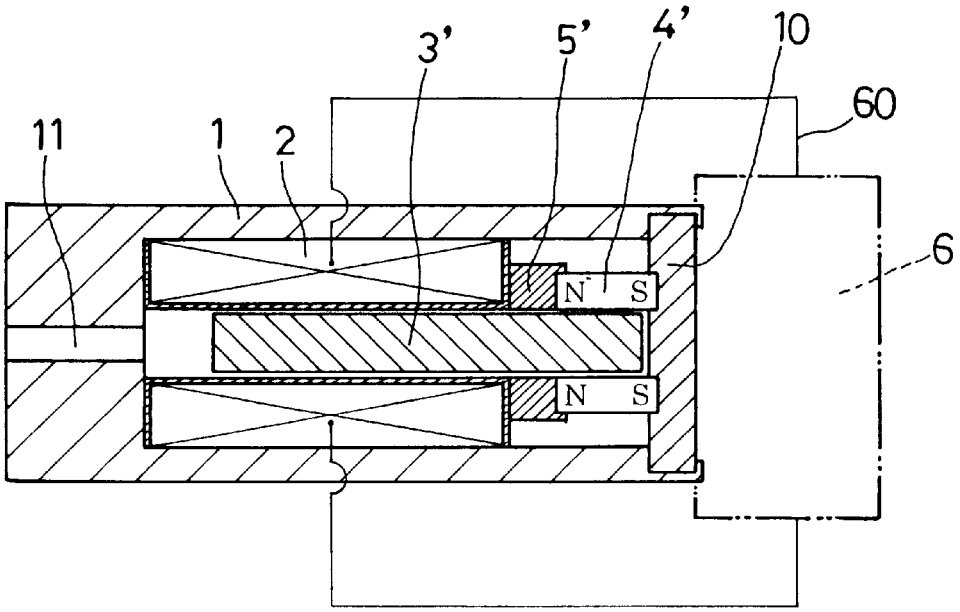
FIG. 4 is a cutaway view of another applicable embodiment of the present invention, illustrating the position of the iron core shifted to the right.
Figure 5:
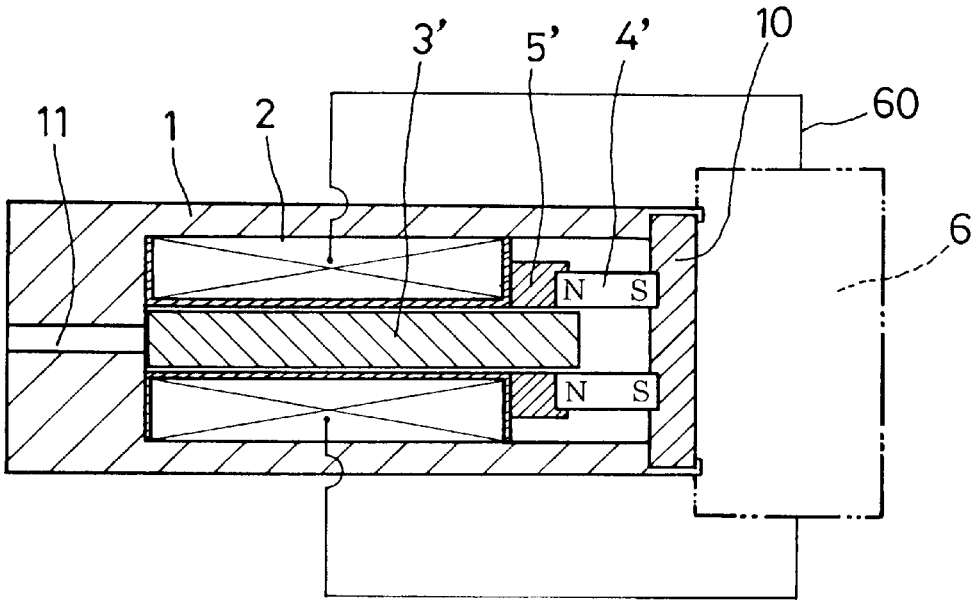
FIG. 5 is a cutaway view of another applicable embodiment of the present invention, illustrating the position of the iron core shifted to the left.
Figure 6:
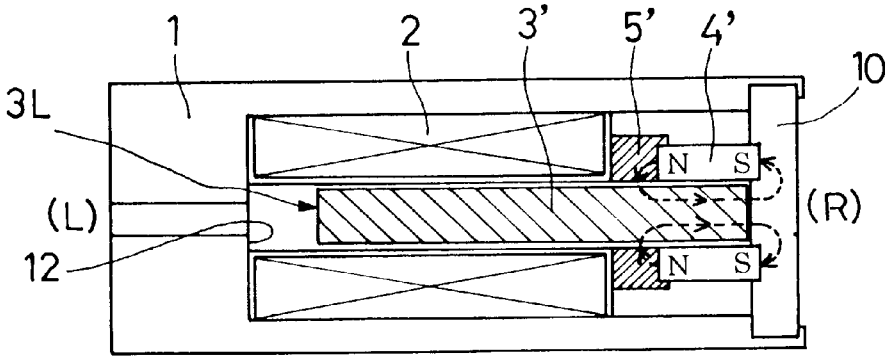
FIG. 6(A) shows lines of force before being excited in accordance with FIG. 4.
FIG. 6(B) shows lines of force in accordance with FIG. 4 when being excited opened by positive impulse voltage.
FIG. 6(C) shows lines of force after the iron core is shifted to the left.
FIG. 6(D) shows lines of force in accordance with FIG. 5 when being excited opened by negative impulse voltage.
FIG. 6(E) shows a schematic drawing after being excited in accordance with FIG. 5.
FIG. 6(F) shows lines of force after the iron core is shifted to the right.
Figure 6:
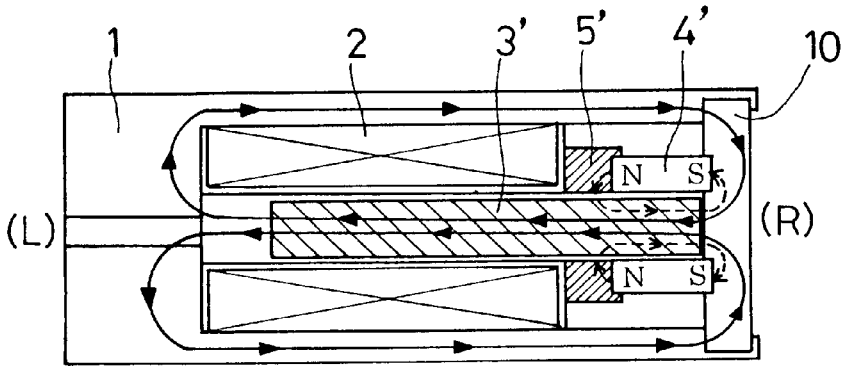
Figure 6:
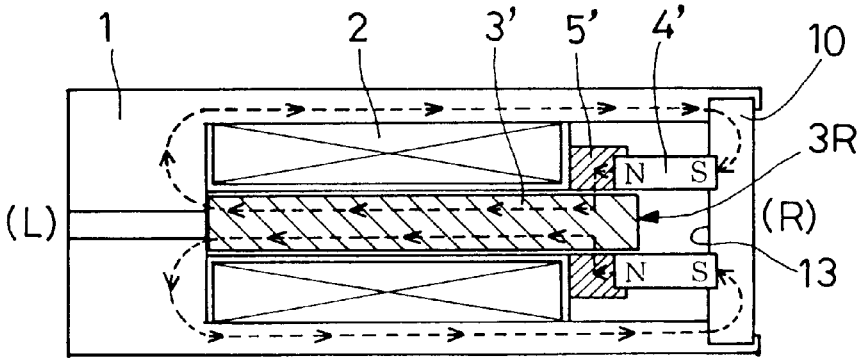
Figure 6:
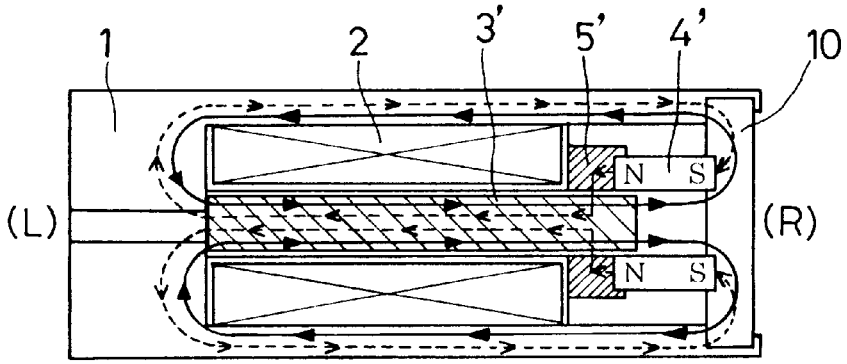
Figure 6:
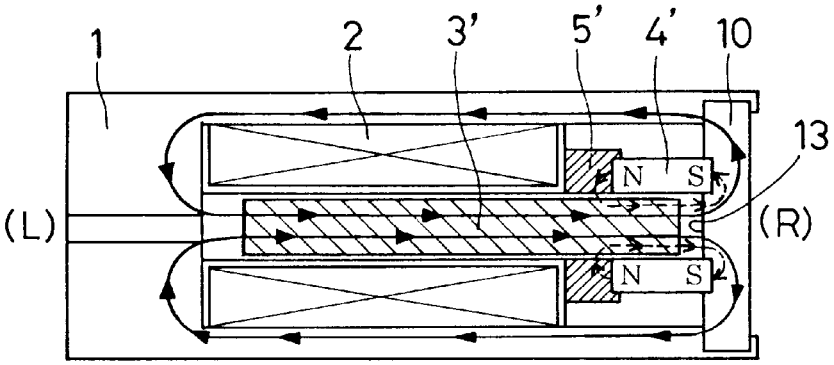
Figure 6:
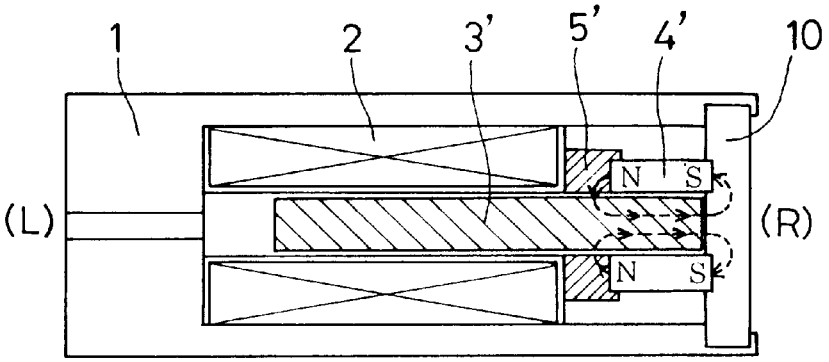

Please return to FIGS. 4 and 5. In addition to the embodiment disclosed in FIGS. 1 and 2, the magnet device in accordance with the present invention has a few variants in form and in position, and the principles thereof are the same. Therefore, another applicable embodiment in accordance with the present invention lies in that the iron core 3' is made to be a solid cylinder while the permanent magnet 4' and the magnet-conductive ring 5' are formed to be ring-shaped bodies, so that the permanent magnet 4' is internally coupled with the iron core 3' and matched with each other. Accordingly, when the coil 2 is opened or closed by being excited, the direction change of the magnetic force of the permanent magnet 4' is performed as shown in FIG. 6 (A) through (F). As the effect thereof is all the same to that in FIG. 3(A) through (F), it won't be described herein any more.

The embodiment of the two above-mentioned magnet devices, no matter with the methods of internal or external coupling of the magnet-conductive ring 5 or 5' and the iron core 3 or 3', the clearance between them can change the holding force to be increased or decreased. Thus, it is able to be changeable in accordance with wishes. Of course, if the magnetic force of the permanent magnet is strong enough, the magnet-conductive ring can be spared. It is a tendency to ask for reduction of magnet device volume so that the magnet-conductive ring can be spared in accordance with the using purpose to reduce its volume and cost.

Figure 11:
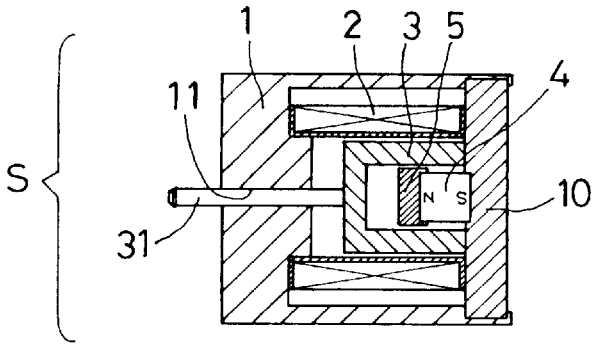
FIG. 11 is a schematic drawing of the present invention applied to solenoids.

FIG. 11 shows that the magnet device in accordance with the present invention is connected with an actuating lever 31 at the front end of the iron core 3, protruding in the bore hole 11 so that a solenoid (S) is formed for using.

Figure 12:
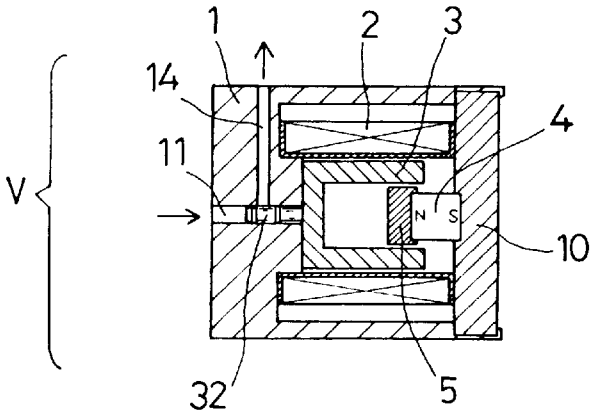
FIG. 12 is a schematic drawing of the present invention applied to electromagnetic valves.

FIG. 12 shows that the magnet device in accordance with the present invention is fitted with a valve hole 14 at the front end of the external housing 1 and connected with a pistol lever 32 at the front end of the iron core 3 for moving in the bore hole 11 in order to form an electromagnetic valve (V) type.

Figure 13:
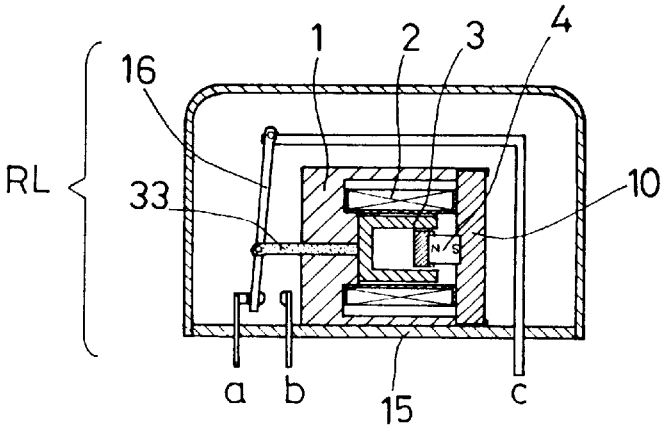
FIG. 13 is a schematic drawing of the present invention applied to relays.
Figure 14:
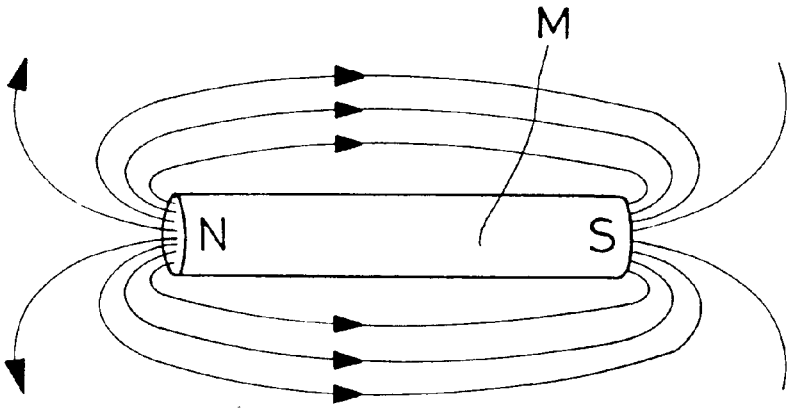
FIG.14 (PRIOR ART)
FIG. 14 shows line of force for common permanent magnet.
Figure 15:
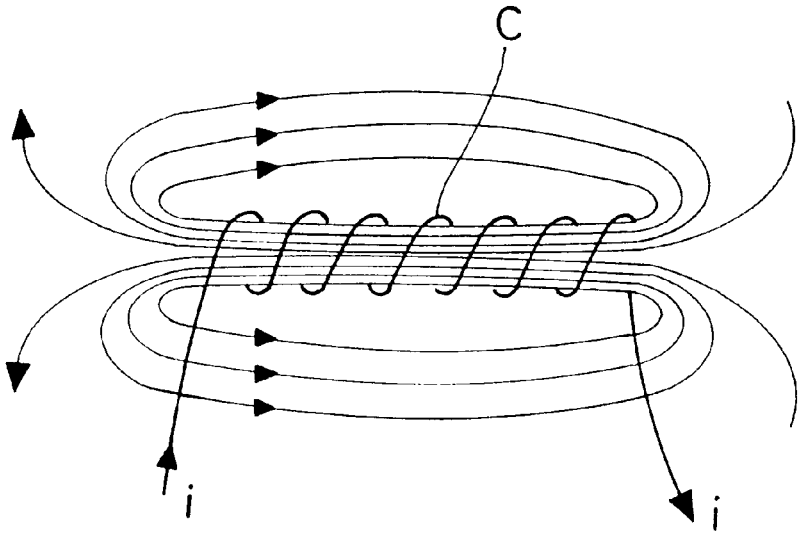
FIG.15 (PRIOR ART)
FIG. 15 shows line of force for common solenoids.
Figure 16:
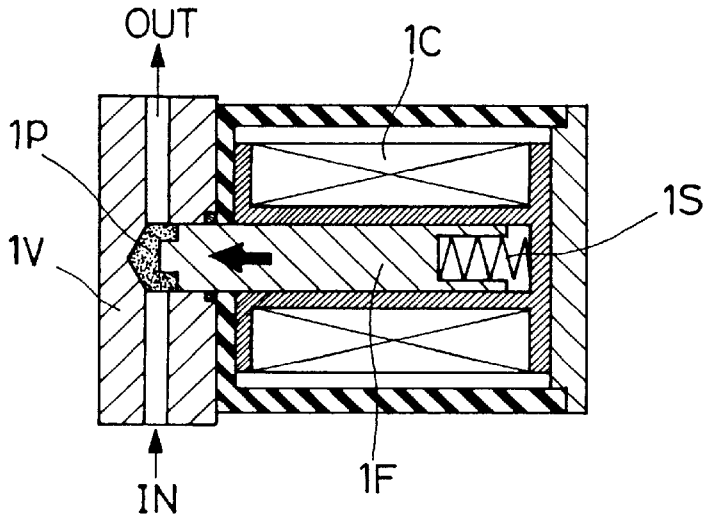
FIG.16 (PRIOR ART)
FIG. 16 is a schematic drawing of a conventional electromagnetic valve, illustrating a state being excited closed.
Figure 17:
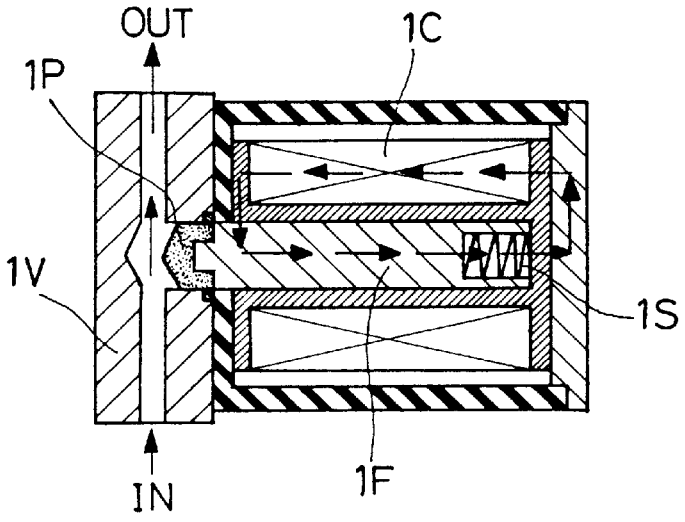
FIG.17 (PRIOR ART)
FIG. 17 is a schematic drawing of a conventional electromagnetic valve, illustrating a state being excited opened.

FIG. 13 shows that the magnet device in accordance with the present invention is mounted on an isolation base 15 whose iron core 3 is connected with an isolation level 33 protruding in the bore hole 11 in order to push a reversing lever 16 pivoted on the C junction point to control the A or B junction points connected thereto. Accordingly, a relay is formed for using.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A magnet device with double fixing positions for changing a magnetic circuit comprising:

an external housing whose inner edge is fitted with a coil, whereby an inside of said external housing includes a space for axial movement of an iron core at different positions, and a portion of a main body of the iron core being coupled with an inner edge of said coil;

said external housing and a positioning cover at an open end of said housing being made of metal with excellent magnetic conductivity, and an outer part of said housing being formed with a radial bore hole, whereby an edge of an inner side of said housing in conjunction with an outer face of said iron core forms an attracting holding face for attracting and attaching with each other; and that said iron core is magnetically coupled to a permanent magnet which is fixed at an inner side of said positioning cover, and that the inner side of said positioning cover at an edge of the permanent magnet forms an attracting holding face for attracting and attaching an inner face of said iron core; and a drive circuit independently installed or installed at one side face of said external housing whose power output wire is connected with said coil, so that a positive impulse voltage will be exported and electrical energy is stored in a capacitor when power is switched on, while a discharge current is created to export a negative impulse voltage after power is switched off, whereby the positive and the negative impulse voltage serves to make said coil change direction of a magnetic force generated by said coil so that a push force or a pull force on said iron core will be created for movement thereof, and whereby said permanent magnet will be forced to change the magnetic circuit, and said iron core under a power-off state will be kept at the pre-arranged position.

2. The magnet device with double fixing positions for changing a magnetic circuit of claim 1, wherein said permanent magnet has a magnetically conductive ring at another magnetic pole opposite to the magnetic pole at its fixed end.

3. The magnet device with double fixing positions for changing a magnetic circuit of claim 1, wherein said iron core is a hollow cylinder fitted with an opening at one end thereof, while said permanent magnet is cylindrical and mounted to be disposed in the hollow portion of said iron core, so that said permanent magnet is externally coupled with said iron core.

4. The magnet device with double fixing positions for changing a magnetic circuit of claim 1, wherein said iron core is connected to a member selected from the group consisting of an actuating lever, a pistol lever and a control lever, which are movable with said iron core.

5. A magnet device with double fixing positions for changing a magnetic circuit of claims 1, or 4, wherein said iron core is a solid cylinder while said permanent magnet is formed with a ring-shaped body, so that said permanent magnet is internally coupled with the iron core.

* * * * *